US005150963A

United States Patent [19]

Hill

[11] Patent Number: 5,150,963

[45] Date of Patent: Sep. 29, 1992

[54] CHRISTMAS TREE LIGHT RECEPTACLE APPARATUS

[76] Inventor: Shirley J. Hill, 830 Douglas St., Covington, Tenn. 38019

[21] Appl. No.: 817,343

[22] Filed: Jan. 6, 1992

[51] Int. Cl.[5] ..... F21V 23/00

[52] U.S. Cl. ..... 362/123; 362/101; 362/226; 362/458

[58] Field of Search ..... 362/123, 122, 226, 249, 362/252, 806, 101, 253, 457, 458, 96

[56] References Cited

U.S. PATENT DOCUMENTS

| | | | |
|---|---|---|---|
| 2,047,045 | 7/1936 | Veenboer | 362/123 |
| 2,230,900 | 2/1941 | Neitzke | 362/123 |
| 2,414,866 | 1/1947 | Glaser | 362/123 |
| 2,453,695 | 11/1948 | Belling | 362/123 |
| 2,533,222 | 12/1950 | Cohen | 362/123 |
| 2,969,456 | 1/1961 | Raymaley | 362/123 |
| 4,099,824 | 7/1978 | Schoppelrey | 362/123 |
| 4,516,193 | 5/1985 | Murphy | 362/123 |

FOREIGN PATENT DOCUMENTS

| | | | |
|---|---|---|---|
| 615231 | 2/1961 | Canada | 362/123 |
| 837726 | 6/1960 | United Kingdom | 362/123 |

*Primary Examiner*—Richard R. Cole

*Attorney, Agent, or Firm*—S. Michael Bender

[57] ABSTRACT

A torroidal ring member including a central bore is arranged to receive a Christmas tree therethrough above the Christmas tree support base. The torroidal ring includes an outer cylindrical wall concentric with an inner cylindrical wall, with the outer cylindrical wall including a continuous array of electrical receptacle members therewithin to receive electrical receptacle portions of Christmas tree lights mounted to the associated tree. A modification of the invention includes the torroidal ring member formed with first and second semi-cylindrical portions securable together to form the torroidal ring member. Each semi-cylindrical housing is arranged to accommodate a fluid trough to contain a scented potpourri therewithin for projection through an apertured plate positioned above each trough.

1 Claim, 4 Drawing Sheets

CHRISTMAS TREE LIGHT RECEPTACLE APPARATUS

BACKGROUND OF THE INVENTION

1. Field of the Invention

The field of the invention relates to Christmas tree apparatus, and more particularly pertains to a new and improved Christmas tree light receptacle apparatus wherein the same is arranged for the convenience of a Christmas tree lighting receptacle member for providing electrical energy to various lights and accessories mounted to a Christmas tree.

2. Description of the Prior Art

Providing a proper electrical receptacle relative to a Christmas tree can at times be a very difficult and time consuming procedure, particularly in use with contemporary lights that are wired in series, wherein a failure of a single light bulb may effect operation of an entire electrical illumination strip. Accordingly, the instant invention attempts to overcome deficiencies of the prior art by providing for a ring member arranged for securement to the tree by directing the tree through the ring member, and the ring member including outlets formed to an outer wall of the ring member for receiving individual electrical plugs.

Prior art electrical outlet members are available in the prior art and are exemplified in the U.S. Pat. No. 4,867,701 to Wyand setting forth the use of a longitudinal plug member arranged for reception of a plurality of electrical plugs therewithin.

U.S. Pat. No. 4,717,350 to Lax sets forth a multiple outlet strip of a longitudinal configuration formed with integral grounding of an electrical strip therewithin.

U.S. Pat. No. 4,493,515 to Banks sets forth a multiple electrical outlet strip construction typical of the prior art.

As such, it may be appreciated that there continues to be a need for a new and improved Christmas tree light receptacle apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of light receptacle apparatus now present in the prior art, the present invention provides a Christmas tree light receptacle apparatus arranged for the reception of a plurality of Christmas tree light plugs therewithin and accommodating the Christmas tree therethrough. As such, the general purpose of the present invention, which will be described subsequently in greater detail, is to provide a new and improved Christmas tree light receptacle apparatus which has all the advantages of the prior art light receptacle apparatus and none of the disadvantages.

To attain this, the present invention provides a torroidal ring member including a central bore arranged to receive a Christmas tree therethrough above the Christmas tree support base. The torroidal ring includes an outer cylindrical wall concentric with an inner cylindrical wall, with the outer cylindrical wall including a continuous array of electrical receptacle members therewithin to receive electrical receptacle portions of Christmas tree lights mounted to the associated tree. A modification of the invention includes the torroidal ring member formed with first and second semi-cylindrical portions securable together to form the torroidal ring member. Each semi-cylindrical housing is arranged to accommodate fluid trough to contain a scented potpourri therewithin for projection through an apertured plate positioned above each trough.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas tree light receptacle apparatus which has all the advantages of the prior art light receptacle apparatus and none of the disadvantages.

It is another object of the present invention to provide a new and improved Christmas tree light receptacle apparatus which may be easily and efficiently manufactured and marketed.

It is a further object of the present invention to provide a new and improved Christmas tree light receptacle apparatus which is of a durable and reliable construction.

An even further object of the present invention is to provide a new and improved Christmas tree light receptacle apparatus which is susceptible of a low cost of manufacture with regard to both materials and labor, and which accordingly is then susceptible of low prices of sale to the consuming public, thereby making such Christmas tree light receptacle apparatus economically available to the buying public.

Still yet another object of the present invention is to provide a new and improved Christmas tree light receptacle apparatus which provides in the apparatuses and methods of the prior art some of the advantages thereof, while simultaneously overcoming some of the disadvantages normally associated therewith.

There together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
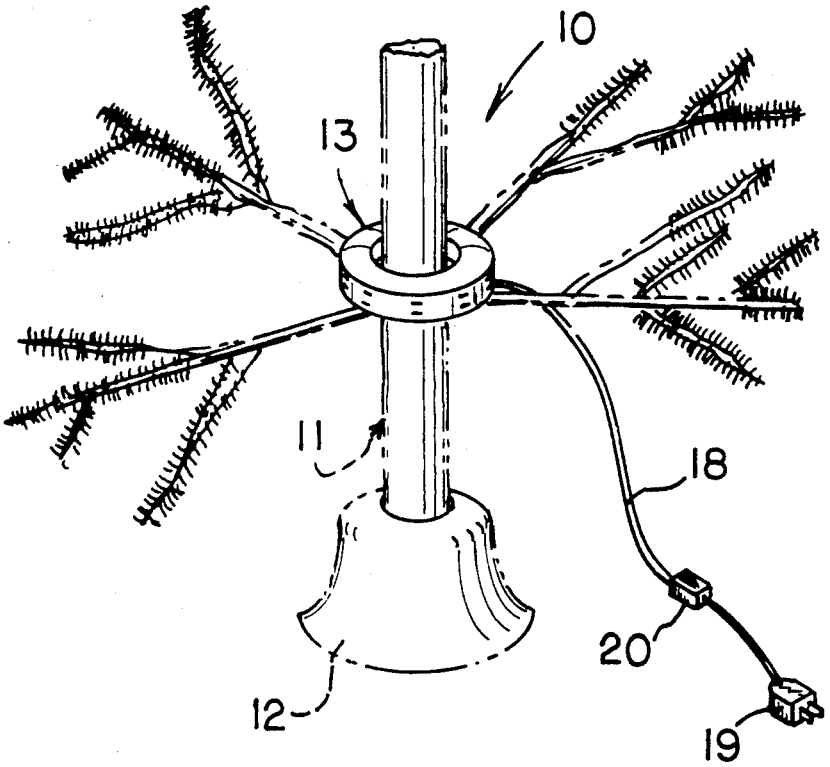
FIG. 1 is an isometric illustration of the instant invention in use.
Figure 2:
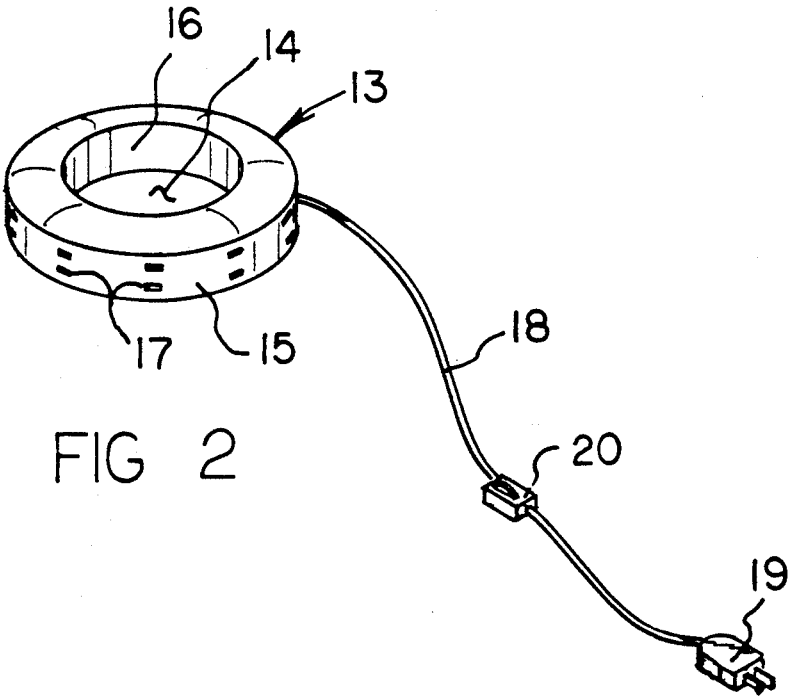
FIG. 2 is an isometric illustration of the instant invention.
Figure 3:
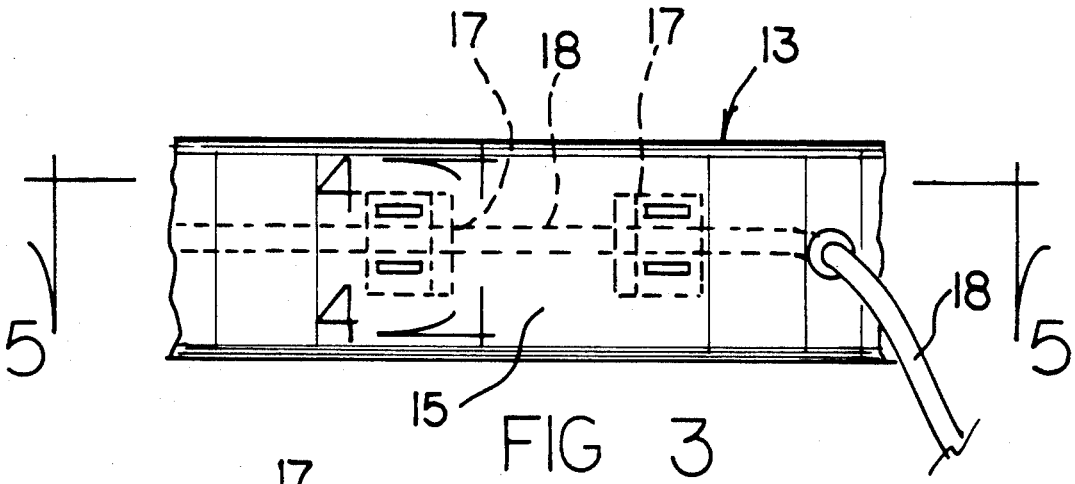
FIG. 3 is an enlarged orthographic view of the instant invention.
Figure 4:
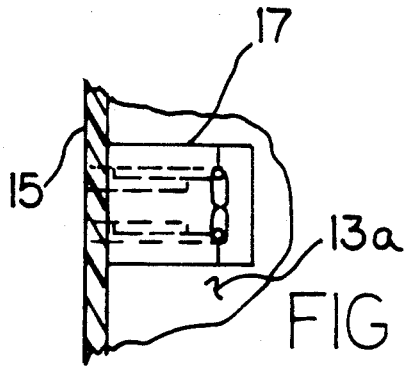
FIG. 4 is an orthographic view, taken along the lines 4—4 of FIG.3 in the direction indicated by the arrows.
Figure 5:
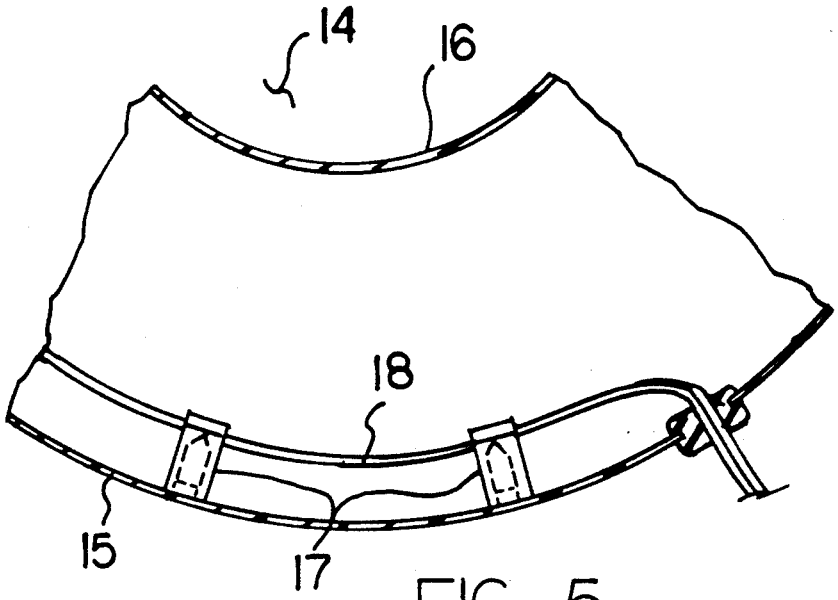
FIG. 5 is an orthographic view, taken along the lines 5—5 of FIG. 3 in the direction indicated by the arrows.

With reference now to the drawings, and in particular to FIGS. 1 to 8 thereof, a new and improved Christmas tree light receptacle apparatus embodying the principles and concepts of the present invention and generally designated by the reference numerals 10, 10*a*, and 10*b* will be described.

More specifically, the Christmas tree light receptacle apparatus 10 of the instant invention essentially comprises the provision of a torroidal ring 13 receiving a Christmas tree 11 through a central axial bore 14 of the ring 13. The Christmas tree 11 is mounted to a support base 12 as illustrated in FIG. 1 below the torroidal ring 13. The torroidal ring 13 is formed with a cylindrical outer wall 15 concentric with a cylindrical inner ring 16 defining a ring cavity 13*a* within the torroidal ring 13. A plurality of electrical receptacles 17 each including a plurality of openings to receive a pronged electrical plug therewithin are mounted coextensively within the cavity 13*a*, with the openings of each receptacle 17 directed through the outer wall 15. Electrical supply line 18 is provided, and includes an electrical supply line plug 19 at its free distal end to include a switch 20 between the ring 13 and the plug 19. The electrical receptacles 17 are in electrical series throughout the torroidal ring 13.

Figure 6:
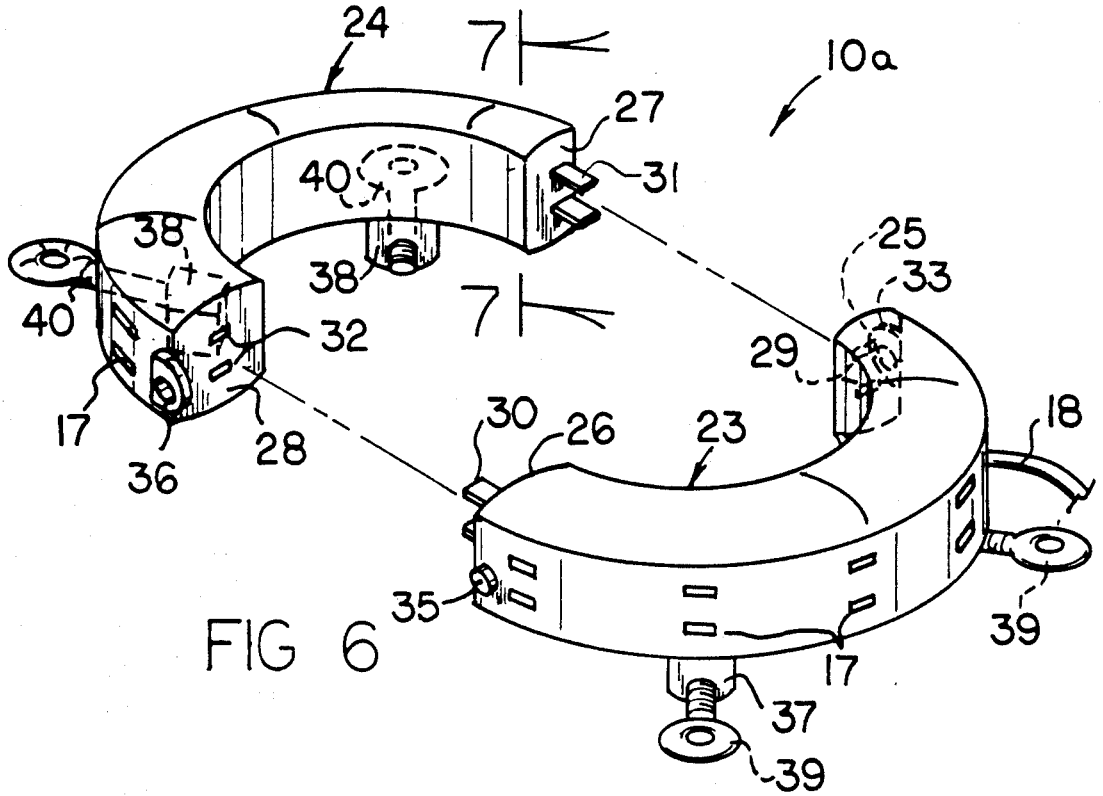
FIG. 6 is an isometric exploded view of a modification of the invention.
Figure 7:
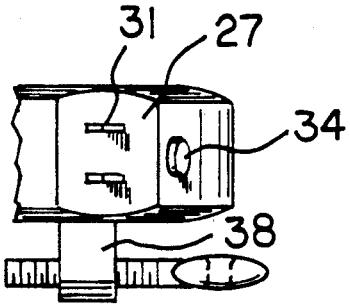
FIG. 7 is an orthographic view, taken along the lines 7—7 of FIG. 6 in the direction indicated by the arrows.

The FIG. 6 illustrates a modified apparatus including a modified torroidal ring housing 22 to include first semi-cylindrical housing 23 secured to a second semi-cylindrical housing 24 when secured together configured to form the torroidal ring structure, as illustrated in FIG. 6. The first housing includes a first housing end wall 25 coplanar with a first housing second end wall 26. The second housing includes a second housing first end wall 27 coplanar with a second housing second end wall 28. The first housing first end wall includes a first housing first end wall receptacle 29 and a first housing second end wall plug 30. The first housing first end wall receptacle 29 is cooperative with a second housing first end wall plug 31 and the first housing second end wall plug 30 is cooperative with a second housing second end wall receptacle 32 to effect electrical communication between the first and second semi-cylindrical housings 23 and 24 to direct electrical current from the electrical supply line 18 throughout the torroidal ring housing structure. The first housing further includes a first housing deflective latch flange 33 including a first bore therethrough projecting beyond the first housing first end wall 25 in a tangential mounting relative to the first housing. A second housing second housing boss plug 34 mounted tangentially relative to the second housing first end wall 27 is received within the first bore. A first housing boss plug 35 mounted tangentially adjacent the first housing second end wall is received within a second bore of a second housing deflectable latch flange 36, including a central bore therethrough to secure the first and second housings together in a secure relationship. Further, a plurality of first boss members 37 mounted to a bottom surface of the housing, with a plurality of second boss members 38 mounted to a bottom surface of the second housing. Threaded first rods 39 are radially directed towards the cylindrical inner wall 16 positioned therebelow, with externally threaded second rods threadedly directed through the second boss members 38 radially directed towards and below the cylindrical inner wall 16. The threaded rods 39 and 40 are arranged for securement to the Christmas tree 11 to provide for the torroidal ring 22 to be secured in a stable relationship relative to the tree structure.

Figure 8:
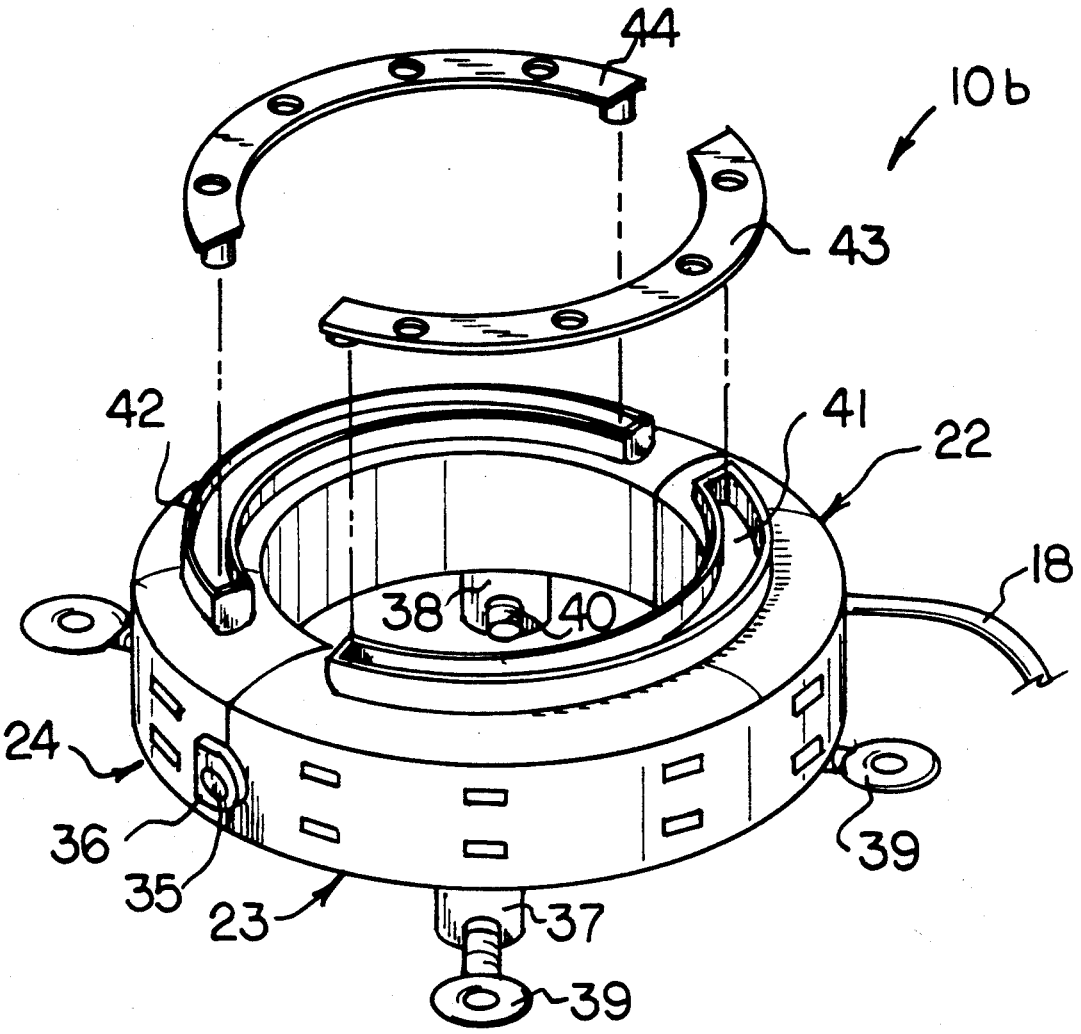
FIG. 8 is an isometric illustration of a further modification of the invention.

The further modified 10*b*, as illustrated in FIG. 8, includes a structure as set forth relative to FIG. 6, but further includes respective first and second trough 41 and 42 mounted to a top surface of the respective first and second housings 23 and 24 to receive various fluid fragrances or potpourri therewithin. A respective first and second apertured plate 43 and 44 is mounted to a top surface of the first and second troughs 41 and 42 to meter the fragrance contained within each trough exteriorly of the trough for enhancing enjoyment and usage of the organization relative to a Christmas tree environment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention invention.

What is claimed as being new and desired to be protected by Letters Patent of the United States is as follows:

1. A Christmas tree light receptacle apparatus, comprising, a torroidal ring housing, the torroidal ring housing including a central axial bore directed coaxially therethrough arranged to receive a Christmas tree through the axial bore, and the torroidal ring housing further including a cylindrical outer wall concentric with an inner wall, and the cylindrical outer wall including a plurality of electrical receptacles directed into the housing from the outer wall, and an electrical supply line directed into the housing in electrical communication with each receptacle, and the ring housing includes a first semicylindrical housing and a second semi-cylindrical housing, with the first semi-cylindrical housing including a first housing first end wall and a first housing second end wall in coplanar relationship, the second semi-cylindrical housing including a second housing first end wall and a second housing second end wall arranged in a coplanar relationship, the first housing first end wall includes a first housing first end wall receptacle, and the first housing second end wall including a first housing second end wall plug, the second housing first end wall including a second housing first end wall plug and the second housing second wall including a second housing second end wall receptacle, the first housing first end wall receptacle received within the second housing first end wall plug, and the first housing second end wall plug received within the second housing second end wall plug received within the second housing second end wall receptacle to effect electrical communication of the first semi-cylindrical housing with the second semi-cylindrical housing and the electrical supply line, and the first housing includes a first housing deflectable latch flange, including a first bore directed therethrough, wherein the first housing deflectable latch flange is tangentially aligned relative to the first housing extending orthogonally beyond the first housing first end wall, and the second housing including a second housing first end wall, and the second housing including a second housing boss plug positioned to the cylindrical outer wall adjacent the second housing first end wall, wherein the second housing boss plug is received within the first bore, and the first housing including a first housing boss plug mounted to the outer wall of the ring housing positioned adjacent the first housing second end wall, and the second housing including a second housing latch flange with a second bore directed therethrough positioned adjacent and orthogonally extending beyond the second housing second end wall tangentially mounted to the cylindrical outer wall to receive the first housing boss plug within the second bore, and the first semi-cylindrical housing includes a plurality of first boss members mounted to a bottom surface of the first housing, and the second housing including a plurality of second boss members mounted to a bottom wall of the second housing, with the first boss members each receiving a threaded first rod directed therethrough, wherein each threaded first rod is radially aligned relative to the threaded second rods are radially aligned relative to the axial bore positioned therebelow, and the first housing includes a first housing top wall and the first housing top wall includes a first trough mounted thereon, and the second housing includes a second housing top wall, and the second housing top wall includes a second trough mounted thereon, and the first trough and the second trough mounted thereon, and the first trough and the second trough are arranged for reception of fluid and potpourri therewithin, and the first trough includes a first aperture plate mounted to an upper distal end of the first trough, and the second aperture plate is arranged for securement to an upper distal end of the second trough, wherein the first aperture plate and the second aperture plate meter fragrance directed through the respective first and second apertured plate from the respective first and second trough.

* * * * *